US010342285B2

(12) United States Patent
Aoki et al.

(10) Patent No.: US 10,342,285 B2
(45) Date of Patent: Jul. 9, 2019

(54) BICYCLE SHOE

(71) Applicant: Shimano Inc., Sakai, Osaka (JP)

(72) Inventors: Toshiaki Aoki, Sakai (JP); Junichi Kikuta, Sakai (JP)

(73) Assignee: SHIMANO INC., Osaka (JP)

( * ) Notice: Subject to any disclaimer, the term of this patent is extended or adjusted under 35 U.S.C. 154(b) by 0 days.

(21) Appl. No.: 14/631,840

(22) Filed: Feb. 26, 2015

(65) Prior Publication Data

US 2016/0249704 A1 Sep. 1, 2016

(51) Int. Cl.
*A43B 5/14* (2006.01)
*A43B 13/14* (2006.01)

(52) U.S. Cl.
CPC ..... *A43B 5/14* (2013.01); *A43B 13/14* (2013.01)

(58) Field of Classification Search
CPC ..... A43B 5/14; A43B 5/145; A43B 5/007; A43B 5/00; A43B 5/006; A43B 5/003; B62M 3/086
USPC ..... 36/114, 131, 103
See application file for complete search history.

(56) References Cited

U.S. PATENT DOCUMENTS 4,188,737 A * 2/1980 Haver ..... A43B 1/0036 36/131
4,803,894 A * 2/1989 Howell ..... A43B 5/14 36/131
4,815,333 A * 3/1989 Sampson ..... B62M 3/086 36/131
5,125,173 A * 6/1992 Nagano ..... A43B 5/14 36/131
5,131,291 A * 7/1992 Beyl ..... A43B 5/14 36/131
5,205,056 A * 4/1993 Okajima ..... A43B 5/14 36/131
5,280,680 A * 1/1994 Burke ..... A43B 13/14 36/114
5,836,094 A * 11/1998 Figel ..... A43B 3/0073 36/131
5,845,421 A * 12/1998 Tanaka ..... A43B 5/0401 36/115
6,260,291 B1 * 7/2001 Farys ..... A43B 5/14 36/107
7,536,810 B2 * 5/2009 Jau, Jr. ..... A43B 5/14 36/131
2001/0022041 A1 * 9/2001 Gebhard ..... A43B 5/14 36/131
2009/0320641 A1 12/2009 Delgorgue et al.
2012/0240430 A1 9/2012 Shin

FOREIGN PATENT DOCUMENTS

JP 02275498 * 10/1990 ..... B62M 3/08
JP 2010-263970 A 11/2010

* cited by examiner

*Primary Examiner* — Katharine Gracz

(57) ABSTRACT

A bicycle shoe includes a sole. The sole includes a recess, which is recessed from a bottom surface of the sole. The recess is defined by a bottom portion and lateral surfaces. The bottom portion has a lateral dimension, which is greater than or equal to 20 millimeters and less than or equal to 45 millimeters.

20 Claims, 5 Drawing Sheets

BICYCLE SHOE

BACKGROUND OF THE INVENTION

The invention generally relates to bicycle shoes for clipless pedals. More specifically, the present invention is related to a bicycle shoe with a recess for engaging a pedal while the pedal is disengaged from a cleat.

In recent years, one type of bicycle pedal that has been gaining popularity is the step-in or clipless pedal, which engages a cleat secured to the sole of the shoe. With this type of bicycle pedal, the rider steps onto the pedal, and a clamping mechanism automatically grips the cleat. When releasing the shoe from the pedal, the rider will typically turn the shoe about an axis perpendicular to the tread of the pedal. As a result of the pivoting action, the clamping mechanism releases the cleat.

In mountain bike shoes for clipless pedals, the cleat area is typically recessed into the sole of the shoe. The clamping mechanism of the pedal is typically raised from the tread of the pedal and fits into the cleat recess. However, when biking downhill in particular, mountain bike riders often disengage from the cleats and step on the pedal with a part of the sole that has no cleat. When disengaged from the cleats, the raised parts of the clamping mechanism do not provide a flat surface for secure engagement with the bottom surface of the shoe. In other words, the raised clamping mechanism may interfere with the engagement between the tread of the pedal and the bottom surface of the shoe sole.

SUMMARY OF THE INVENTION

A bicycle shoe includes a sole, and the sole includes a recess, which is recessed from a bottom surface of the sole. The recess is defined by a bottom portion and lateral surfaces. The bottom portion has a lateral dimension, which is greater than or equal to 20 millimeters and less than or equal to 45 millimeters.

In another aspect of the bicycle shoe, the recess has a size and a shape which are configured such that the lateral surfaces are adapted to engage a cleat engagement member of a bicycle pedal, and the bottom surface of the sole is configured to contact a pedal body of the bicycle pedal.

In another aspect of the bicycle shoe, the lateral surfaces are inclined with respect to the bottom surface of the sole.

In another aspect of the bicycle shoe, the lateral surfaces are inclined such that the recess is relatively wide near the bottom surface of the sole and relatively narrow near the bottom portion of the recess as measured in the lateral direction of the sole.

In another aspect of the bicycle shoe, a side surface angle, which is between each of the lateral surfaces and the bottom surface of the sole, is in a range of 90 to 150 degrees.

In another aspect of the bicycle shoe, the side surface angle is approximately 130 degrees.

In another aspect of the bicycle shoe, the side surface angle decreases in a longitudinal rearward direction of the sole.

In another aspect of the bicycle shoe, the a maximum lateral distance between the lateral surfaces is greater than or equal to 30 millimeters and less than or equal to 50 millimeters.

In another aspect of the bicycle shoe, a maximum lateral distance between the lateral surfaces is approximately 33 millimeters.

In another aspect of the bicycle shoe, the maximum lateral distance between the lateral surfaces decreases in a rearward longitudinal direction of the sole.

In another aspect of the bicycle shoe, the recess is further defined by a rear surface, which is located rearward of the bottom portion.

In another aspect of the bicycle shoe, the rear surface is located to engage a rear surface of the cleat engagement member.

In another aspect of the bicycle shoe, the rear surface is inclined with respect to the bottom surface of the sole.

In another aspect of the bicycle shoe, the rear surface is inclined with respect to the bottom surface of the sole such that a part of the rear surface that is adjacent to the bottom surface of the sole is rearward of apart of the rear surface that is adjacent to the bottom portion of the recess.

In another aspect of the bicycle shoe, a rear surface angle, which is formed between the rear surface and the bottom surface of the sole, is in a range of 90 to 150 degrees.

In another aspect of the bicycle shoe, the rear surface angle is approximately 145 degrees.

In another aspect of the bicycle shoe, a maximum longitudinal dimension of the recess, as measured in a longitudinal direction of the shoe, is greater than or equal to 65 millimeters.

In another aspect of the bicycle shoe, a maximum depth dimension of the recess, as measured between the bottom surface of the sole and the bottom portion of the recess is greater than 4 millimeters.

In another aspect of the bicycle shoe, the maximum depth dimension is approximately 6 millimeters.

In another aspect of the bicycle shoe, the depth dimension is approximately 7 millimeters.

In another aspect of the bicycle shoe, the sole includes a cleat attachment portion, and the recess is located rearward of the cleat attachment portion.

In another aspect of the bicycle shoe, the recess is a first recess, and the cleat attachment portion is defined by a second recess formed in the bottom surface of the sole.

In another aspect of the bicycle shoe, the first recess is integrally joined with the second recess.

Other advantages and features of the present invention will become apparent to those skilled in the art from the following detailed description and the drawings.

DESCRIPTION OF THE EMBODIMENTS

Figure 1:
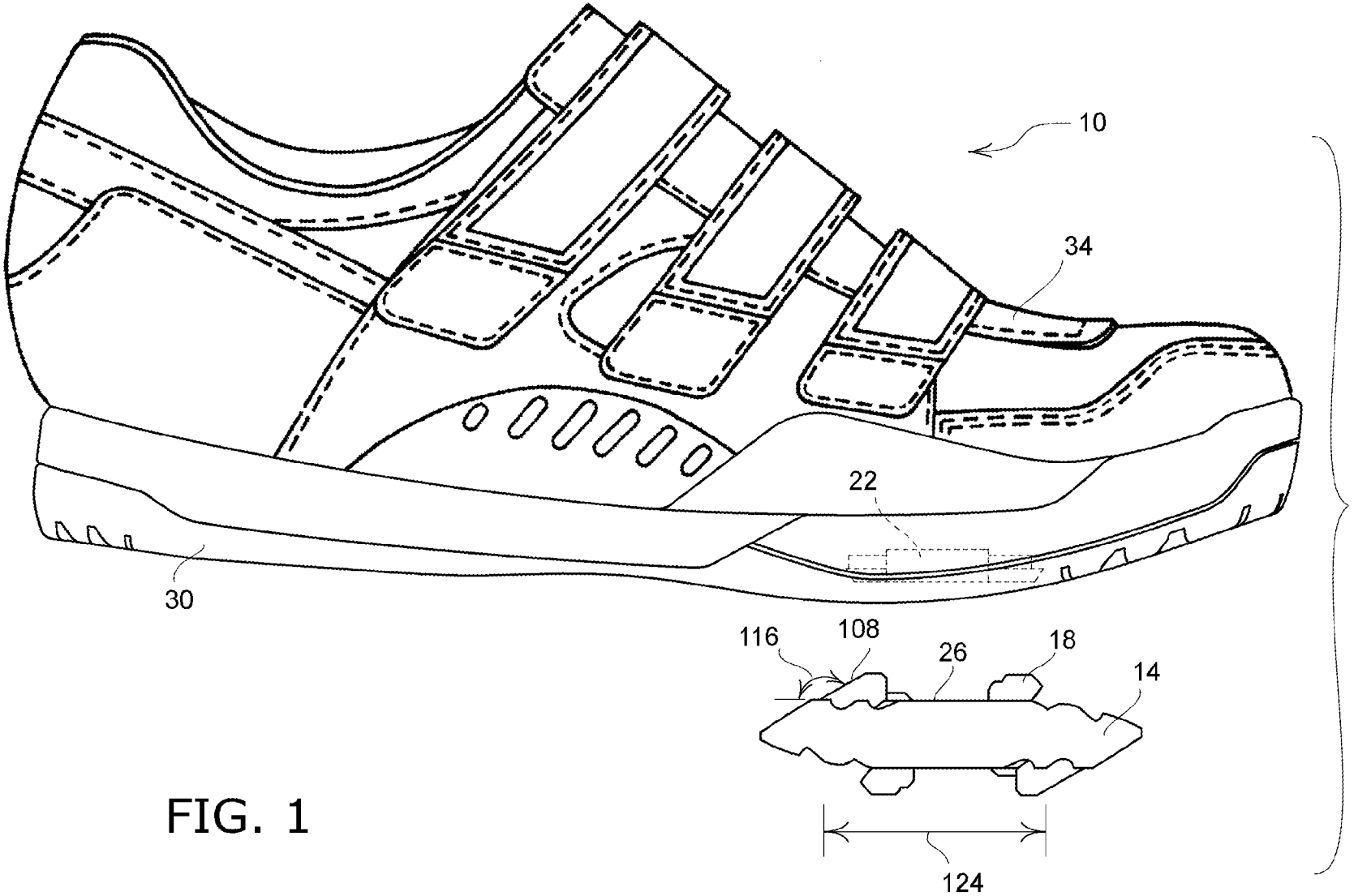
FIG. 1 is a side view of a right shoe of the present invention and a bicycle pedal with parts omitted for simplicity.
Figure 2:
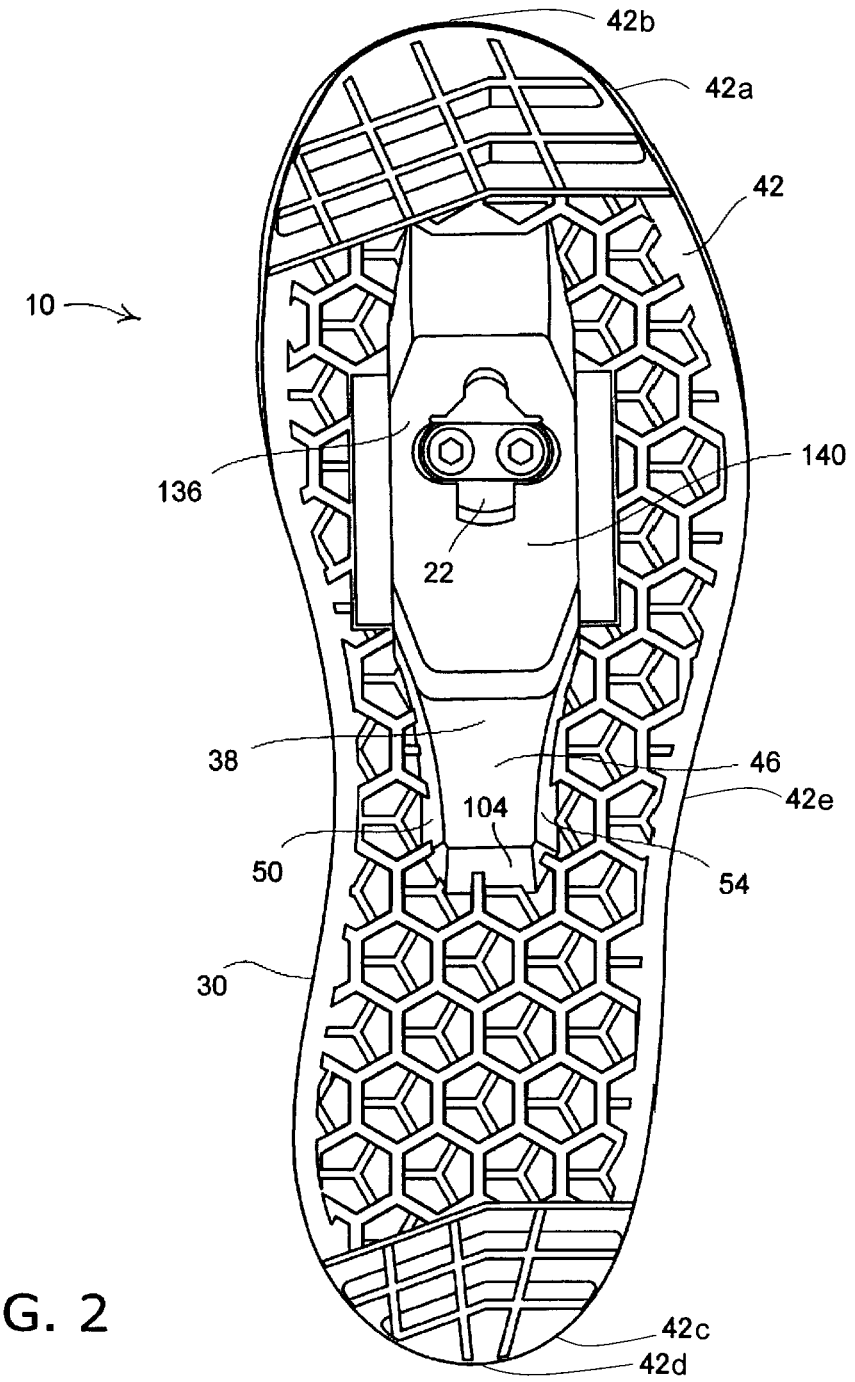
FIG. 2 is a bottom plan view of a left sole of the shoe of the present invention.

FIG. 1 shows a right bicycle shoe 10 above a pedal 14. The left shoe 10, a bottom plan view of which appears in FIG. 2, is a mirror image of the right shoe 10. The pedal 14 has a cleat engagement member 18 for engaging a cleat 22, which is fixed to the sole 30 of the shoe 10. The cleat 22 is a conventional cleat and its construction and manner of being fixed to the shoe 10 are well known. Thus, details of the cleat 22 and its manner of attachment are not described herein.

Figure 3:
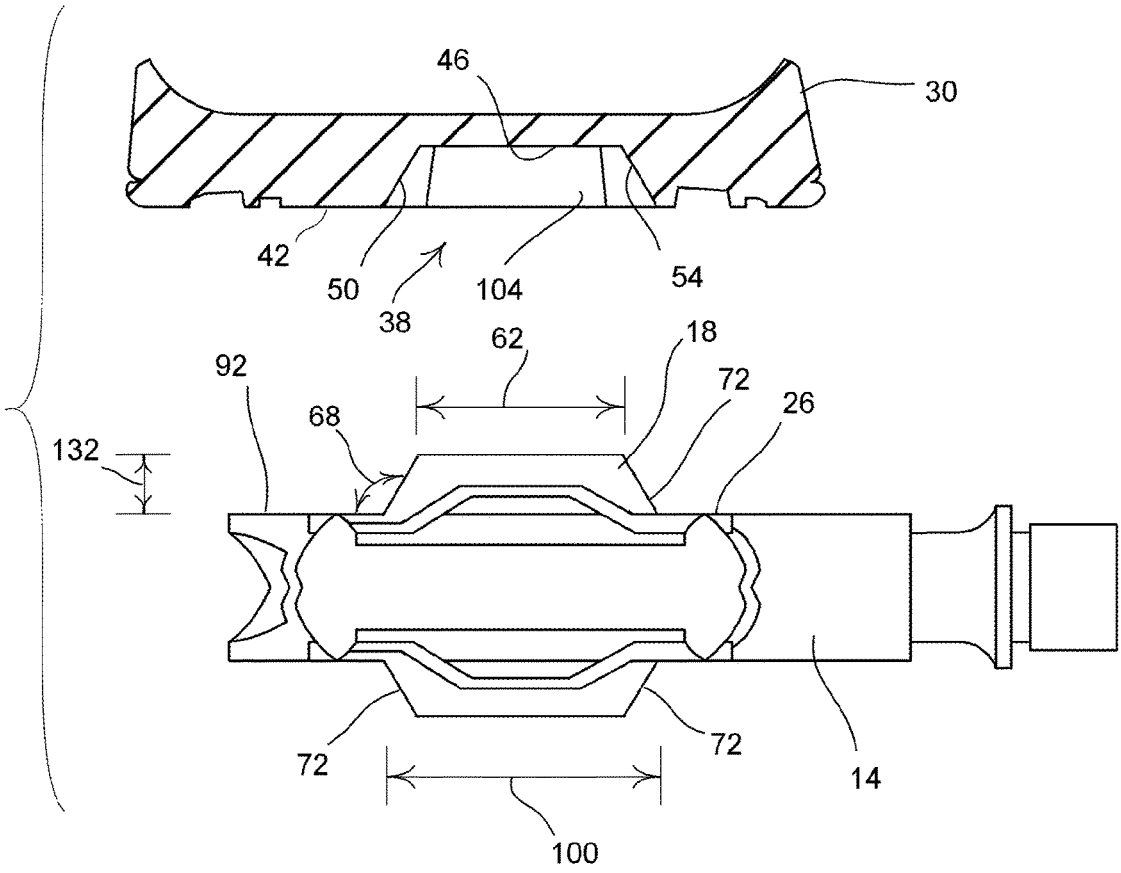
FIG. 3 is a diagrammatic front view, partly in a cross sectional plane that is perpendicular to a longitudinal axis of the shoe, as seen from the right side of FIG. 1.

As shown in FIG. 3, the pedal 14 further includes a pedal body 26, which extends laterally on opposite sides of the cleat engagement member 18. The pedal 14 is connected to a crank (not illustrated), which is fitted to a frame (not illustrated) in a conventional manner.

The shoe 10 includes an upper 34, which is conventional and is not described in detail herein. In addition, the shoe 10 includes the sole 30. The bottom surface 42 of the sole 30 has a toe portion 42*a* including a foremost end 42*b* of the sole 30, a heel portion 42*c* including a rearmost end 42*d* of the sole 30, and a shank portion 42*e* that is a narrowest-width portion between the toe portion 42*a* and the heel portion 42*c* in a bottom plan view as shown in FIG. 2. Referring to FIGS. 2 and 3, the sole 30 includes a recess 38, which is recessed from a bottom surface 42 of the sole 30. The bottom surface 42 of the sole 30 is the surface that normally contacts the ground when walking with the shoe 10. The sole 30 is constructed of any conventional shoe sole material that is known for being used to make bicycle shoes or athletic shoes.

The recess 38 is defined by a bottom portion 46 and lateral surfaces 50, 54. The bottom portion 46 of the recess 38 is the surface defining the highest part of the recess 38 when the sole 30 of the shoe 10 is facing downward (facing the ground). The lateral surfaces 50, 54 extend between sides of the bottom portion 46 and the bottom surface 42 of the sole 30 as shown in FIGS. 2 and 3. Preferably, the bottom portion 46 has a lateral dimension 58 that is greater than or equal to 20 millimeters and less than or equal to 45 millimeters. See FIG. 6. The range of the lateral dimension 58 of the bottom portion 46 is chosen to include the lateral dimensions 62 of the corresponding upper surfaces of the cleat engagement members 18 of existing pedals 14.

The size and shape of the recess 38 are configured such that the lateral surfaces 50, 54 are adapted to engage the cleat engagement member 18 of the bicycle pedal 14. The bottom surface 42 of the sole 30 is configured to contact the pedal body 26 of the bicycle pedal 14. More specifically, as shown in FIG. 3, the recess 38 is trapezoidal to match the trapezoidal shape of the cleat engagement member 18 of the pedal 14, and the bottom surface 42 is configured to contact the body 26, or tread, of the pedal 14. In this embodiment, the body 26 is generally flat and the bottom surface 42 of the sole 30 is generally flat. However, the body 26 and the bottom surface 42 can have various other configurations.

Figure 6:
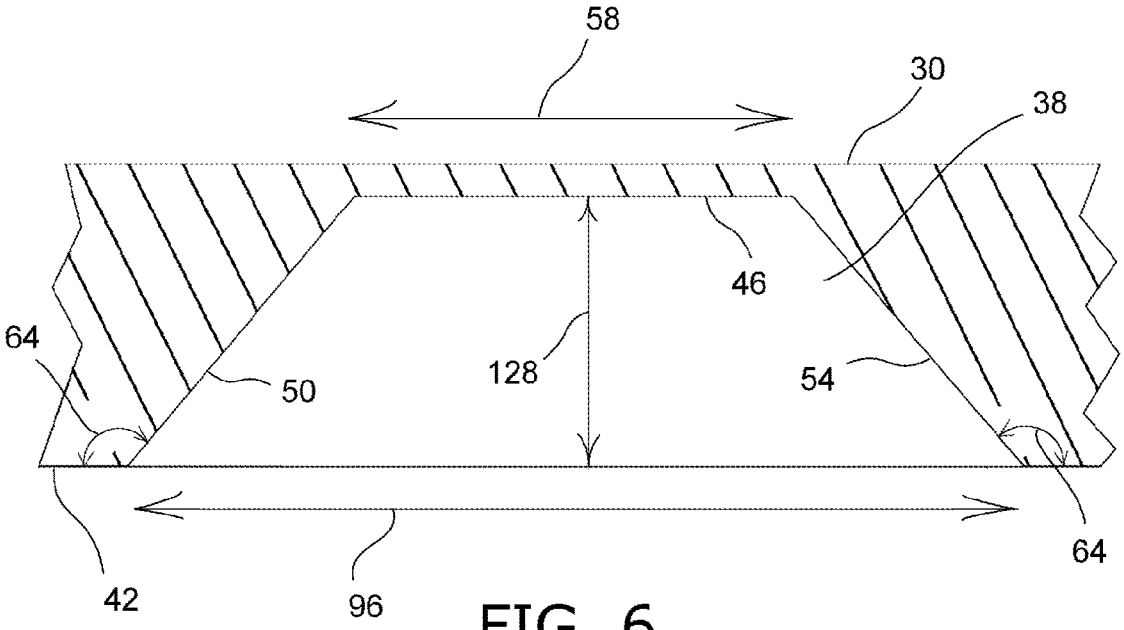
FIG. 6 is a diagrammatic cross sectional view of the recess taken in a plane that is perpendicular to the longitudinal axis of the shoe.

The lateral surfaces 50, 54 are inclined with respect to the bottom surface 42 of the sole 30. More specifically, as shown in FIGS. 3 and 6, the lateral surfaces 50, 54 are inclined such that the recess 38 is relatively wide near the bottom surface 42 of the sole 30 and relatively narrow near the bottom portion 46 of the recess 38 as measured in the lateral direction of the sole 30. Further, as shown in FIG. 6, a side surface angle 64, which is between each of the lateral surfaces 50, 54 and the bottom surface 42 of the sole 30, is in a range of 90 to 150 degrees. This range is chosen to approximately conform to the shapes of cleat engagement members 18 of known pedals 14. More preferably, the side surface angle 64 is approximately 130 degrees. The side surface angle 64 of approximately 130 degrees is preferred for conformance with the cleat engagement member 18 of a particular existing pedal 14. For example, FIG. 3 shows a side angle 68, which is formed between a side wall 72 of the cleat engagement member 18 and an upper surface 92 of the body 26. The side surface angle 64 is chosen to conform to the corresponding side angle 68 of the cleat engagement member 18.

The side surface angle 64 is not necessarily constant in the longitudinal direction of the shoe 10. Preferably, as shown in FIG. 2, the side surface angle 64 decreases in a longitudinal rearward direction of the sole 30. This makes it easy for a rider to first fit the recess 38 over the cleat engagement member 18 near the front of the recess 38, which is relatively wide, and then slide the shoe 10 forward with respect to the pedal 14 to form a secure fit between the cleat engagement member 18 and the surfaces defining the recess 38 at the rear of the recess, which is relatively narrow. In other words, the recess 38 guides the cleat engaging member 18 to the rear of the recess 38.

As shown in FIG. 6, the maximum lateral distance 96 between the lateral surfaces 50, 54 is greater than or equal to 30 millimeters and less than or equal to 50 millimeters. This range is chosen to include the corresponding maximum lateral dimension 100 of the cleat engagement members 18 of existing pedals 14. More preferably, the maximum lateral distance 96 between the lateral surfaces 50, 54 is approximately 33 millimeters. The maximum lateral distance 96 of 33 millimeters is sufficient to span the maximum lateral dimension 100 of the cleat engagement member 18 of a particular existing pedal 14.

Preferably, as shown in FIGS. 2 and 6, the maximum lateral distance 96 between the lateral surfaces 50, 54 decreases in a rearward longitudinal direction of the sole 30. In other words, the recess 38 is tapered in the longitudinal direction of the shoe 10 such that the front of the recess 38 is wider than the rear of the recess. 38. Again, this makes it easy for a rider to first fit the recess 38 over the cleat engagement member 18 near the front of the recess 38 and then slide the shoe 10 forward with respect to the pedal 14 to form a secure fit between the cleat engagement member 18 and the surfaces defining the recess 38. That is, the recess 38 guides the cleat engagement member 18 towards the rear of the recess 38.

Figure 4:
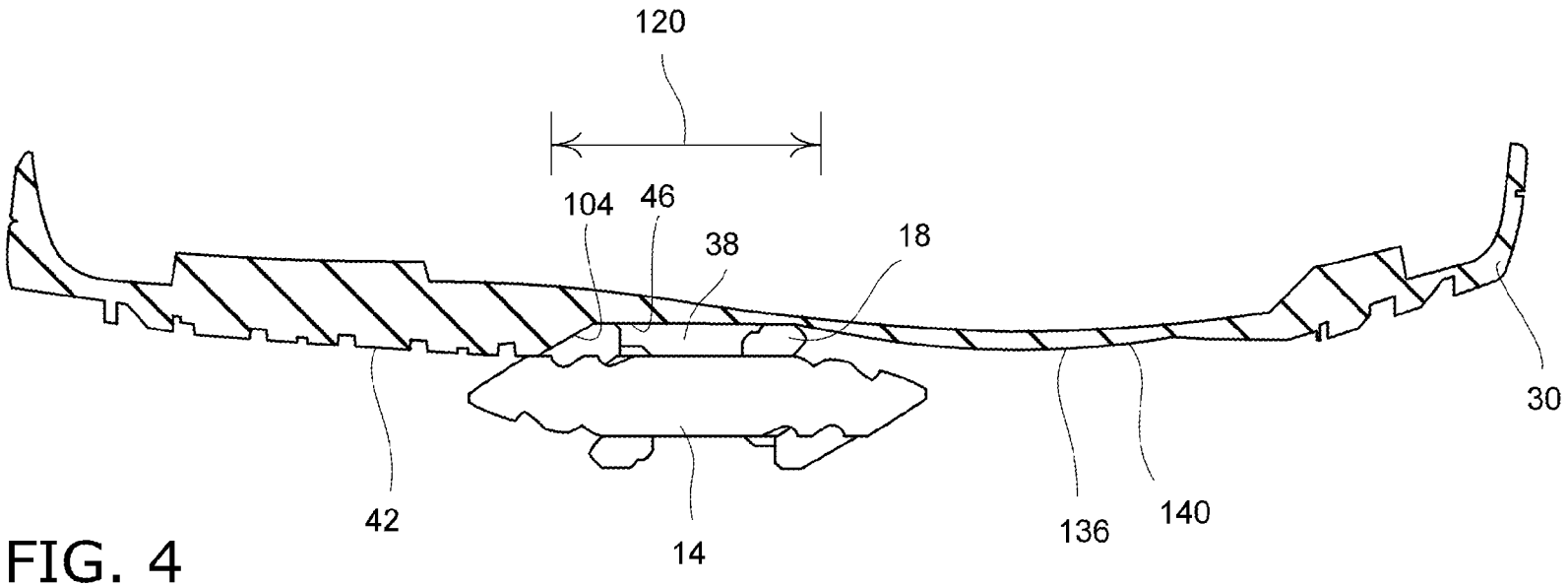
FIG. 4 is a diagrammatic side view, partly taken in a cross sectional plane that includes the longitudinal axis of the shoe.
Figure 5:
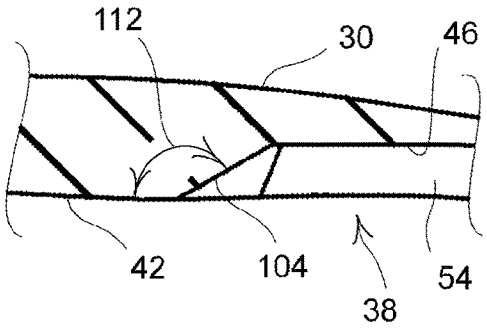
FIG. 5 is a partial longitudinal cross sectional view of a rear part of the recess.

As shown in FIGS. 2 and 5, the recess 38 is further defined by a rear surface 104, which is located rearward of the bottom portion 46. As shown in FIG. 5, the rear surface 104 is inclined with respect to the bottom surface 42 of the sole 30. As shown in FIG. 4, the rear surface 104 is located to engage a rear surface 108 of the cleat engagement member 18. As further shown in FIGS. 2 and 5, the rear surface 104 is inclined with respect to the bottom surface 42 of the sole 30 such that a part of the rear surface 104 that is adjacent to the bottom surface 42 of the sole 30 is rearward of a part of the rear surface 104 that is adjacent to the bottom portion 46 of the recess 38. A rear surface angle 112, which is formed between the rear surface 104 and the bottom surface 42 of the sole 30, is in a range of 90 to 150 degrees. See FIG. 5. This range is chosen to approximately include the corresponding rear surface angle 116 of existing pedals 14. More preferably, the rear surface angle 112 is approximately 145 degrees. The rear surface angle 112 of 145 degrees is preferred for conforming with the cleat engagement member 18 of a particular existing pedal 14. For example, as shown in FIGS. 1 and 5, the rear surface angle 116 of the cleat engagement member 18 is approximately the same as the rear surface angle 112 of the recess 38.

As shown in FIG. 4, the bottom portion 46 is inclined with respect to the bottom surface 42 of the shoe sole 30 in a longitudinal direction of the shoe 10. More specifically, the bottom portion 46 is inclined with respect to the bottom surface 42 such that a part of the bottom portion 46 that is adjacent to the rear surface 104 is closer to the bottom surface 42 of the shoe sole in a direction perpendicular to the bottom surface 42 than a part of the bottom portion 46 that is distant from the rear surface 104. In other words, a rear part of the bottom portion 46, which is adjacent to the rear surface 104, is closer to the bottom surface 42 in a direction perpendicular to the bottom surface 42 than a front part of the bottom portion 46, which is closer to the front end of the shoe 10 than the rear part of the bottom portion 46.

The maximum longitudinal dimension 120 of the recess 38, as measured in a longitudinal direction of the shoe 10, is greater than or equal to 65 millimeters. The maximum longitudinal dimension 120 of the recess 38 is chosen to be at least as long as the maximum corresponding longitudinal dimension 124 of the cleat engagement members 18 of existing pedals 14. As shown in FIGS. 1 and 4, the maximum longitudinal dimension 124 of the cleat engagement member 18 is approximately the same as the maximum longitudinal dimension 120 of the recess 38.

As shown in FIG. 6, the maximum depth dimension 128 of the recess 38, as measured between the bottom surface 42 of the sole 30 and the bottom portion 46 of the recess 38, is greater than 4 millimeters. This dimension is chosen so that the recess 38 accommodates the depth dimension 132 of cleat engagement members 18 of existing pedals 14. If the recess 38 is too shallow, the bottom surface 42 of the sole 30 will not make contact with the body 26 of the pedal 14 when the cleat engagement member 18 is fully fitted in the recess 38. In one preferred embodiment, the maximum depth dimension 128 of the recess 38 is approximately 6 millimeters. The maximum depth dimension 128 of approximately 6 millimeters is preferred to approximately correspond to the depth dimension 132 of a known cleat engagement member 18 of a particular pedal 14. In another preferred embodiment, the depth dimension of the recess 38 is approximately 7 millimeters. The depth dimension 128 of approximately 7 millimeters is preferred to approximately correspond to the depth dimension 132 of a known cleat engagement member 18 of another particular pedal 14.

As shown in FIGS. 1 and 2, the sole 30 includes a cleat attachment portion 136, and the recess 38 is located rearward of the cleat attachment portion 136. In the illustrated embodiment, the recess 38 is a first recess 38, and the cleat attachment portion 136 is defined by a second recess 140 formed in the bottom surface 42 of the sole 30. However, the cleat 22 is not required to be located in a second recess 140 and may be otherwise fixed to the bottom surface 42 of the sole 30. A combination of the bicycle shoe 10 and the cleat engagement member 18 of a bicycle pedal 14 is an example of or may be referred to as a bicycle shoe kit. A combination of the cleat engagement member 18 of the bicycle pedal 14 and the sole 30 for bicycle shoe 10 is an example of or may be referred to as a bicycle shoe sole kit.

As shown in FIG. 2, it is preferred that the first recess 38 is integrally joined with the second recess 140. In other words, the first recess 38 is continuous with and communicates with the second recess 140. Thus, there is nothing to interfere with the shoe 10 when a rider disengages from the cleat engagement member 18 and moves the shoe 10 forward so that the cleat engagement member 18 enters the first recess 38. However, the first recess 38 and the second recess 140 can be independent and separate.

While the invention has been described in detail with respect to specific embodiments, those skilled in the art, upon attaining an understanding of the specific embodiments, may readily conceive of alterations, variations, and equivalents to these embodiments. Accordingly, the scope of the invention should be assessed as that of the appended claims and their equivalents.

The invention claimed is:

1. A bicycle shoe kit, comprising:

a cleat engagement member of a bicycle pedal; and a bicycle shoe comprising a sole, wherein the sole includes a bottom surface having a toe portion, a heel portion, a shank portion that is a narrowest-width portion between the toe portion and the heel portion in a bottom plan view, and a recess, which is recessed from the bottom surface of the sole, the toe portion including a foremost end of the sole, the heel portion including a rearmost end of the sole, the recess is defined by a bottom portion, a rear surface, and lateral surfaces, the bottom portion has a lateral dimension, which is greater than or equal to 20 millimeters and less than or equal to 45 millimeters, the rear surface of the recess is a sloped flat surface inclined with respect to the bottom surface of the sole and linearly extending in a width direction of the sole, the lateral surfaces extend to the rear surface of the recess, wherein a width of the recess defined between the lateral surfaces in a width direction of the sole gradually and continuously decreases in a rearward longitudinal direction of the sole, the recess has a size and a shape that are configured such that the lateral surfaces and the rear surface of the recess are configured to engage side walls and a rear surface of the cleat engagement member of a bicycle pedal such that both the side walls and the rear surface of the cleat engagement member come in surface contact with the lateral surfaces and the rear surface of the recess, respectively, and the bottom surface of the sole is configured to contact a pedal body of the bicycle pedal, the lateral surfaces are inclined with respect to the bottom surface of the sole, at least part of the recess is arranged in the shank portion of the bottom surface of the sole in a bottom plan view, and the rear surface of the recess is closer to the rearmost end of the sole than the foremost end of the sole.

2. The bicycle shoe kit according to claim 1, wherein the lateral surfaces are inclined such that the recess is relatively wide near the bottom surface of the sole and relatively narrow near the bottom portion of the recess as measured in the lateral direction of the sole.

3. The bicycle shoe kit according to claim 2, wherein a side surface angle, which is between each of the lateral surfaces and the bottom surface of the sole, is in a range of 90 to 150 degrees.

4. The bicycle shoe kit according to claim 3, wherein the side surface angle is approximately 130 degrees.

5. The bicycle shoe kit according to claim 3, wherein the side surface angle decreases in a longitudinal rearward direction of the sole.

6. The bicycle shoe kit according to claim 1, wherein a maximum lateral distance between the lateral surfaces of the recess, which is a maximum width of the recess, is greater than or equal to 30 millimeters and less than or equal to 50 millimeters.

7. The bicycle shoe kit according to claim 1, wherein a maximum lateral distance between the lateral surfaces of the recess, which is a maximum width of the recess, is approximately 33 millimeters.

8. The bicycle shoe kit according to claim 1, wherein the rear surface is located rearward of the bottom portion.

9. The bicycle shoe kit according to claim 8, wherein the rear surface is inclined with respect to the bottom surface of the sole such that a part of the rear surface that is adjacent to the bottom surface of the sole is rearward of a part of the rear surface that is adjacent to the bottom portion of the recess.

10. The bicycle shoe kit according to claim 9, wherein a rear surface angle, which is formed between the rear surface and the bottom surface of the sole, is in a range of 90 to 150 degrees.

11. The bicycle shoe kit according to claim 10, wherein the rear surface angle is approximately 145 degrees.

12. The bicycle shoe kit according to claim 8, wherein a maximum longitudinal dimension of the recess, as measured in a longitudinal direction of the shoe, is greater than or equal to 65 millimeters.

13. The bicycle shoe kit according to claim 1, wherein a maximum depth dimension of the recess, as measured between the bottom surface of the sole and the bottom portion of the recess is greater than 4 millimeters.

14. The bicycle shoe kit according to claim 13, wherein the maximum depth dimension is approximately 6 millimeters.

15. The bicycle shoe kit according to claim 13, wherein the depth dimension is approximately 7 millimeters.

16. The bicycle shoe kit according to claim 1, wherein the sole includes a cleat attachment portion, and the recess is located rearward of the cleat attachment portion.

17. The bicycle shoe kit according to claim 16, wherein the recess is a first recess, and the cleat attachment portion is defined by a second recess formed in the bottom surface of the sole.

18. The bicycle shoe kit according to claim 17, wherein the first recess is integrally joined with the second recess.

19. The bicycle shoe kit according to claim 1, wherein the recess is trapezoidal and adapted to match a trapezoidal shape of the cleat engagement member of a bicycle pedal.

20. A bicycle shoe sole kit, comprising:

a cleat engagement member of a bicycle pedal; and a sole for bicycle shoe, the sole including:

a bottom surface having a toe portion and heel portion, the toe portion including a foremost end of the sole, the heel portion including a rearmost end of the sole, a first recess that is recessed from said bottom surface of the sole to a first recess depth and having a first recess bottom surface, a rear surface, and lateral surfaces, the rear surface of the first recess being a sloped flat surface inclined with respect to the bottom surface of the sole and linearly extending in a width direction of the sole, the lateral surfaces extending to the rear surface of the first recess, wherein a width of the first recess defined between the lateral surfaces in a width direction of the sole gradually and continuously decreases in a rearward longitudinal direction of the sole, said lateral surfaces and the rear surface of the first recess are configured to engage side walls and a rear surface of the cleat engagement member of a bicycle pedal such that both the side walls and the rear surface of the cleat engagement member come in surface contact with the lateral surfaces and the rear surface of the first recess, respectively, and such that said bottom surface of the sole contacts a pedal body of the bicycle pedal, and a second recess that extends upwardly from said bottom surface of the sole to a second recess depth and having a second recess bottom surface, said second recess is configured to include a cleat fixed to said bottom surface of the sole, wherein said first recess depth is greater than said second recess depth, said first recess and said second recess are formed in said bottom surface of the sole such that said first recess is continuous with and communicates with said second recess and said first recess is closer to the heel portion of said bottom surface of the sole than the said second recess, and the rear surface of the first recess is closer to the rearmost end of the sole than the foremost end of the sole.

* * * * *